US005155292A

United States Patent [19]

Rostcil et al.

[11] Patent Number: 5,155,292

[45] Date of Patent: Oct. 13, 1992

[54] HEAVY SUPPORT WEAPON

[75] Inventors: Charles E. Rostcil; William C. Baldwin, both of Irvine; John H. Peck, Fountain Valley, all of Calif.

[73] Assignee: Greyden International, Newport Beach, Calif.

[21] Appl. No.: 550,810

[22] Filed: Jul. 10, 1990

Related U.S. Application Data

[63] Continuation of Ser. No. 423,722, Oct. 19, 1989, abandoned, which is a continuation of Ser. No. 307,213, Feb. 3, 1989, abandoned, which is a continuation of Ser. No. 175,630, Mar. 28, 1988, abandoned, which is a continuation of Ser. No. 31,144, Mar. 24, 1987, abandoned, which is a continuation of Ser. No. 659,291, Oct. 5, 1984, abandoned.

[51] Int. Cl.[5] ..... F41A 5/08

[52] U.S. Cl. ..... 89/167; 89/169; 89/177; 89/198

[58] Field of Search ..... 89/37.14, 162, 167, 89/169, 173, 177, 178, 198, 199

[56] References Cited

U.S. PATENT DOCUMENTS

| | | | |
|---|---|---|---|
| 772,700 | 10/1904 | Dawson et al. | 89/199 |
| 1,176,873 | 3/1916 | Swebilius et al. | 89/198 |
| 1,315,329 | 9/1919 | Redpath | 89/199 |
| 1,351,141 | 8/1920 | Thompson | 89/198 |
| 2,459,141 | 1/1949 | Balleisen | 89/198 |
| 2,557,134 | 6/1951 | Mudespacher | 89/198 |
| 2,609,731 | 9/1952 | Sahlin et al. | 89/169 |
| 2,982,183 | 5/1961 | Colby | 89/162 |
| 3,757,636 | 9/1973 | Chiabrandy | 89/169 |

FOREIGN PATENT DOCUMENTS

| | | | |
|---|---|---|---|
| 876010 | 10/1942 | France | 89/198 |

OTHER PUBLICATIONS

Ryan, J. W., Guns, Mortars & Rockets, "Soft Recoil", 1982, pp. 91–94.

*Primary Examiner*—Stephen C. Bentley
*Attorney, Agent, or Firm*—Martens, Olson & Bear Knobbe

[57] ABSTRACT

A heavy support weapon, for example, of 30 mm caliber, designed for firing from conventional machine gun mounts without undue recoil loads transferred to the gun mount. The weapon is designed for first round accuracy whether in the automatic open bolt or semi-automatic closed bolt mode. The weapon 10 includes a barrel 13 joined to a barrel yoke 21 in a receiver 14 aft of a front housing assembly 15. The recoil system includes a main recoil spring 30, a secondary spring 23, a buffer group including rods 60, springs 61 and plate 63. A slide bolt assembly 40 includes a slide 41, a bolt 42, a face 43, bolt face levers 44 and actuating pins 45, all within the receiver 14. The bolt face 43 is driven vertically by the bolt face levers 44 to receive a new round, load it and remove and discharge a spent casing. The slide bolt assembly 40 travels forward and aft during the firing cycle. On rearward travel it is accelerated rearward by accelerator 70 until reaching the buffer group and transfers its kinetic energy to the buffer group which in turn transfers that energy to the barrel 13 and the recoil spring 30 where it is absorbed without transferring the impact loading to the weapon mount.

14 Claims, 12 Drawing Sheets

28A
29
28C
28B
13
16
20
31
30
21
15
13
14

"X"
16
16

Fig. 4
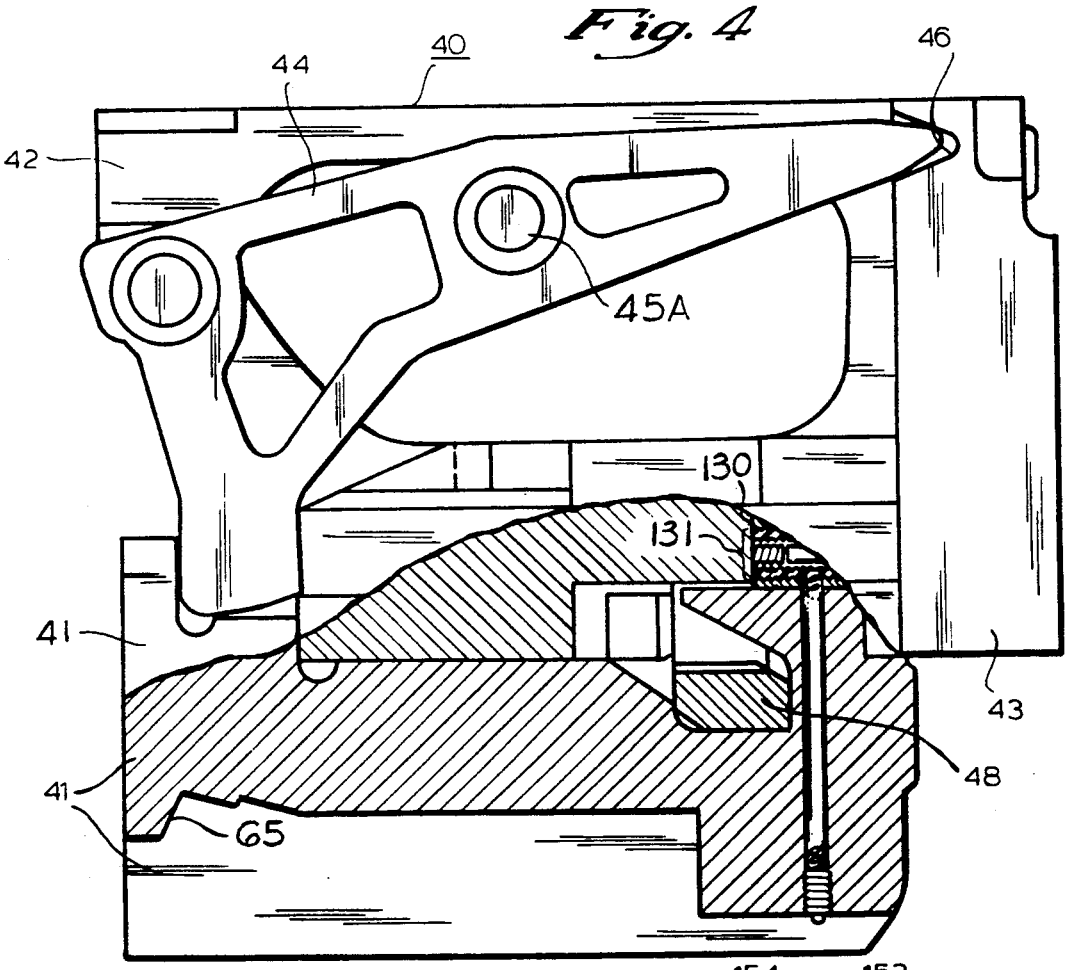
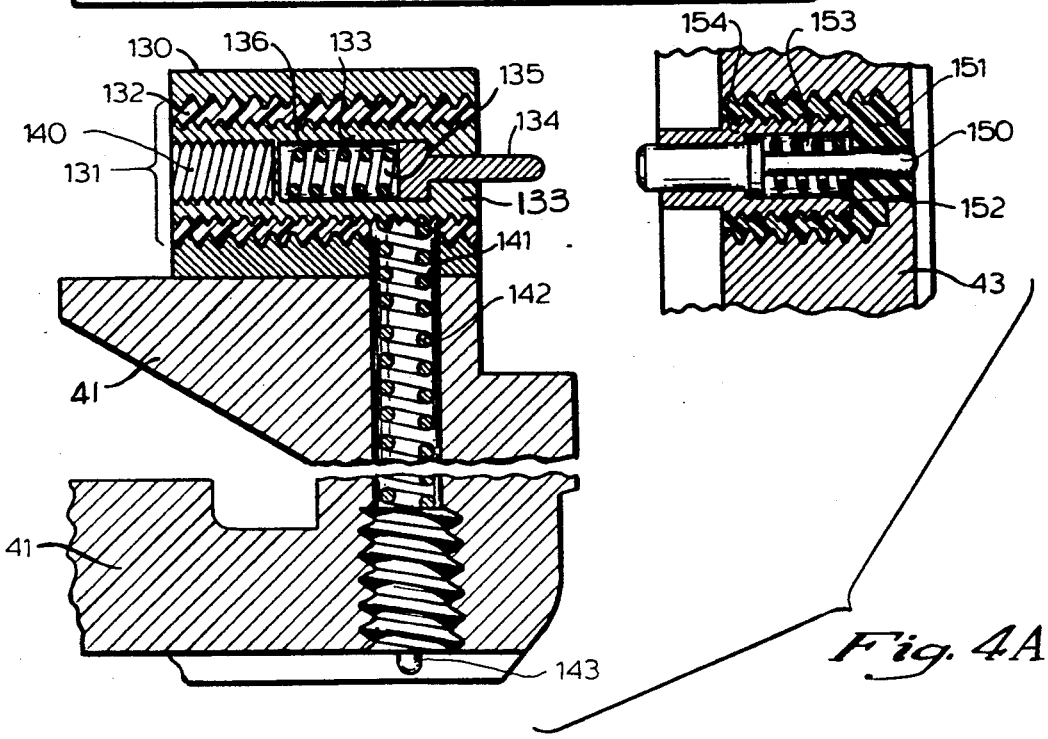
Fig. 4A

Fig. 12
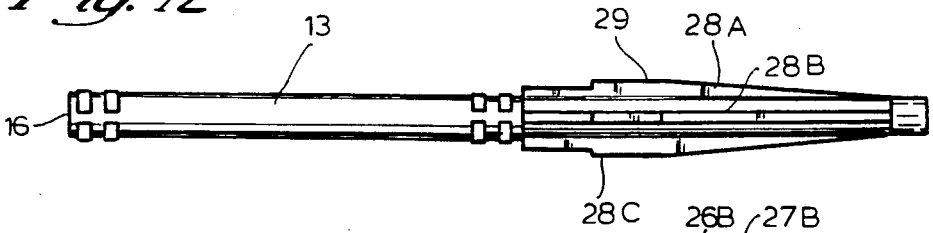
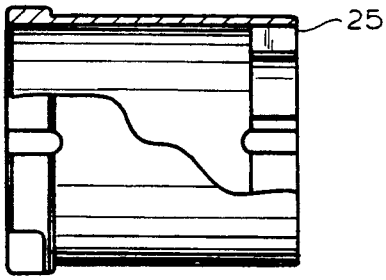
Fig. 13
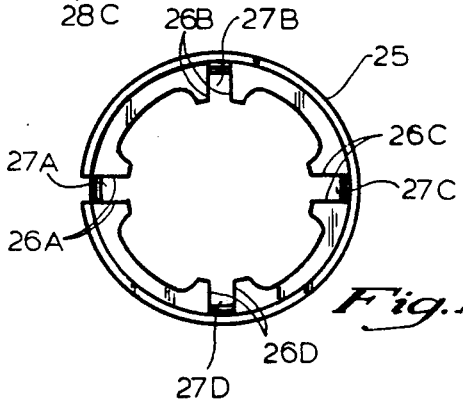
Fig. 14
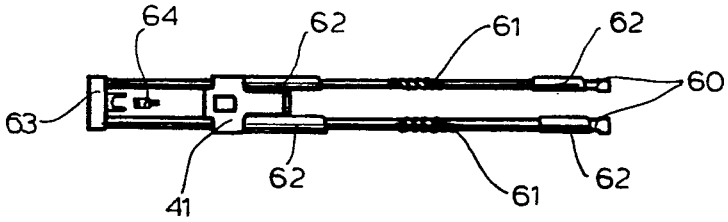
Fig. 15
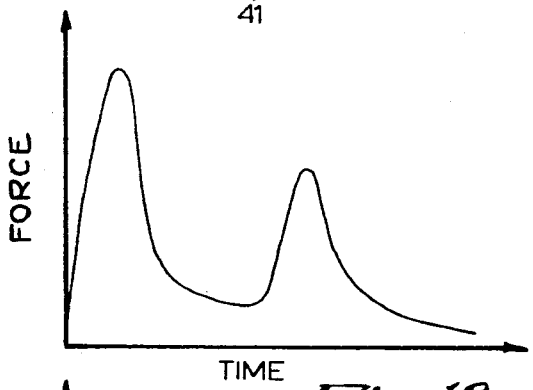
Fig. 19
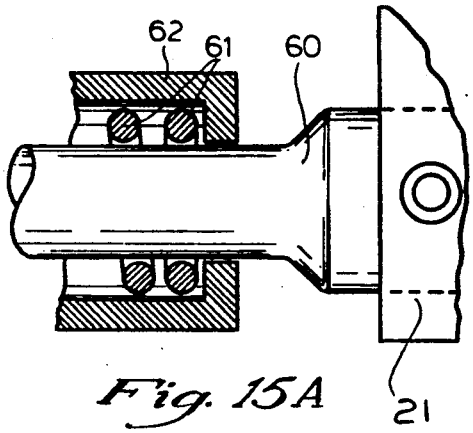
Fig. 15A
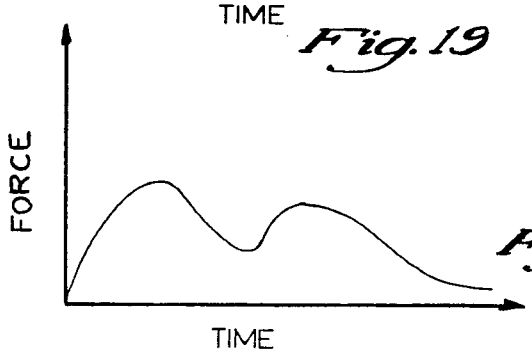
Fig. 20

40
42
44
43
91
20
26
13
22
41
48
90
70
92
A

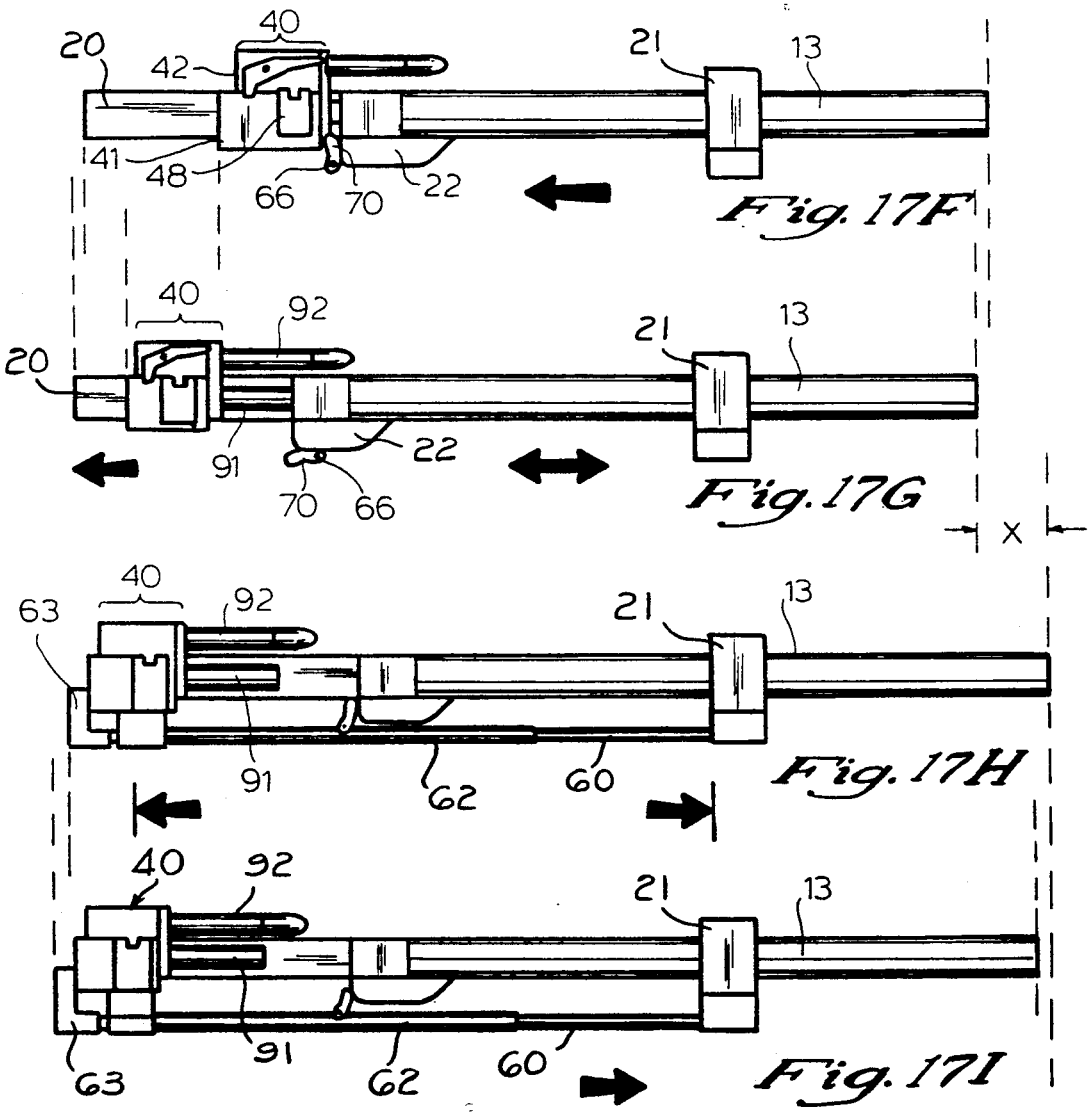
Fig. 18
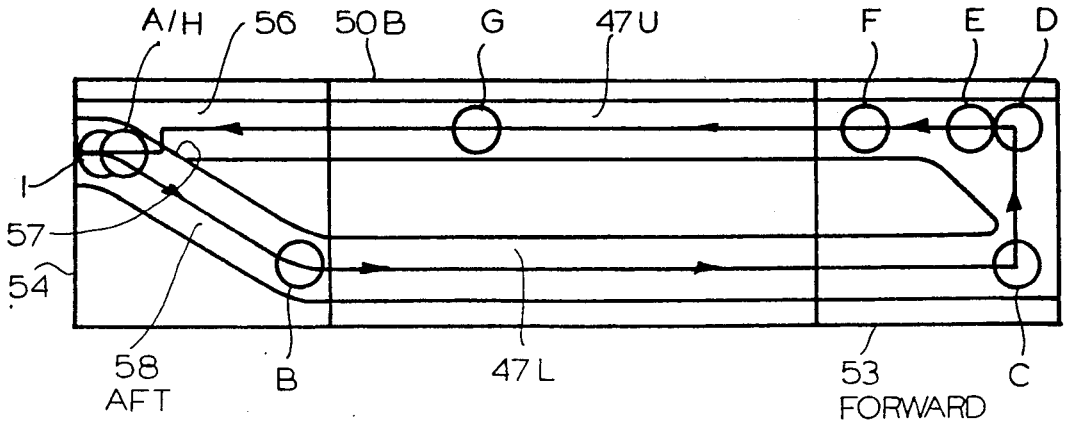

HEAVY SUPPORT WEAPON

This application is a continuation of application Ser. No. 423,722, filed Oct. 19, 1989; which is a continuation of application Ser. No. 307,213, filed Feb. 3, 1989; which is a continuation of application Ser. No. 175,630, filed Mar. 28, 1988, which is a continuation of Ser. No. 031,144, filed Mar. 24, 1987, which is a continuation of application Ser. No. 659,291, filed Oct. 5, 1984, all now abandoned.

BACKGROUND OF THE INVENTION

There has been a perennial need for improved heavy support weapons for military forces. The fifty caliber machine gun has for years been the basic heavy support weapon for American armed forces as well as the armed forces of various other countries. Certain forces employ 25, 30 and 40 millimeter weapons but such generally are too heavy to be man-carried and exhibit such recoil forces that special heavy mounts are needed. This limits their application to larger vehicles. Moreover, such weapons have shorter effective range than the existing 50 caliber machine gun. Therefore, the existing 40 millimeter heavy support weapons fall far short of meeting essential military requirements.

Other requirements not fully satisfied by existing weapons are the need for both automatic open bolt and semi-automatic closed bolt operation and for recoil operation, not externally powered or blowback operated. Minimum recoil for the projectile and load size are desired thereby minimizing the shock loading on the trunnion or other mount. The weapon must be reliable, easily maintained and, if possible, field strippable without special tools. The above requirements, while recognized, have not heretofore been achieved.

Over and above these requirements, the weapon must be accurate in first round firing in either semi-automatic or full automatic firing modes. Accuracy cannot be sacrificed to achieve any of the other above objectives.

BRIEF STATEMENT OF THE INVENTION

Faced with the foregoing needs, we recognized that most of the requirements could be met if recoil energy available with the firing of each round could be properly harnessed and utilized to operate the bolt and charge the weapon for each succeeding round to make the weapon fully recoil operated, and to use the energy upon recoil within the recoil and charging system rather than transmit that shock load to the gun mount. We conceived that the recoil spring itself can be used not only to absorb recoil energy but counter-recoil energy as well, provided that energy can be maintained in the recoil system and not transmitted to the gun mount.

Each of the needs set forth above with respect to heavy support weapons have been achieved by us in the novel weapon of this invention.

Our invention comprises a barrel, a main barrel recoil spring coupled to the barrel, and to a barrel retainer through a barrel yoke. A secondary spring system is coupled between the barrel yoke and a buffer stage which absorbs the impact of the slide and bolt which are accelerated upon recoil of the weapon after each round. The impact energy of the slide striking the buffer group, instead of being transferred to the gun mount, is transferred to the main recoil spring via the barrel yoke.

In this manner the recoil spring is loaded twice during each cycle, the primary and initial load being upon firing and the second and subsidiary loading being from the impact loading of the slide movement and buffering at the end of its rearward movement.

The bolt and slide assembly, which is totally recoil operated, includes a lock which locks the bolt to the barrel through a barrel extension, keeping the bolt closed during the firing of each round.

Accuracy in the weapon is achieved by means of barrel support at both its aft end and at a point nearly two thirds of the distance from the chamber to the muzzle. The aft end of the barrel is secured to a hub in a barrel extension by a $\frac{1}{8}$ turn interrupted thread. The barrel can be further supported in a barrel yoke by a similar type lock and further positioned precisely during recoil and counter-recoil by a barrel bushing secured to the receiver and including longitudinal grooves precisely machined to match the side walls of the barrel fins. The support of the barrel by the barrel bushing is independent of thermal radial expansion of the barrel during sustained firing.

Mounting the weapon on its cradle or gun mount at the forward end of the front housing which encloses the barrel bushing insures minimum upsetting forces.

Altogether, each of the features of this invention cooperate to provide an aircooled, automatic heavy support weapon which is:

- self powered;
- fully or semi-automatic;
- reliable;
- field strippable without tools;
- fully locked action, not blowback operated;
- light in weight; and
- exhibits low impact loading on its support.

BRIEF DESCRIPTION OF THE DRAWING

This invention may be more clearly understood from the following description and by reference to the drawing in which;

FIG. 4 is a side elevational view, partly broken away, of the slide and bolt group of this invention;

FIG. 4A is a breakaway sectional view of the firing contactor arrangement;

FIG. 12 is a side elevational view of the barrel of this invention;

FIG. 13 is a side elevational view partially broken away of the barrel bushing of this invention;

FIG. 14 is a front end view of the barrel bushing of FIG. 13;

FIG. 15A is an enlarged fragementary sectional view of the slide extension buffer rod and drive spring of FIG. 15;

FIG. 15B is a right forward perspective of the buffer assembly of FIG. 15;

FIGS. 17A–I constitute a simplified sequence diagram of the operation of this invention;

FIG. 18 is a simplified operational view of the bolt face lever pin movement in accordance with this invention;

FIG. 19 is a graphical representation of the impulse loading of a conventional weapon upon firing;

FIG. 20 is a graphical reprsentation of the impulse loading of this invention upon firing;

DETAILED DESCRIPTION OF THE INVENTION

Figure 1:
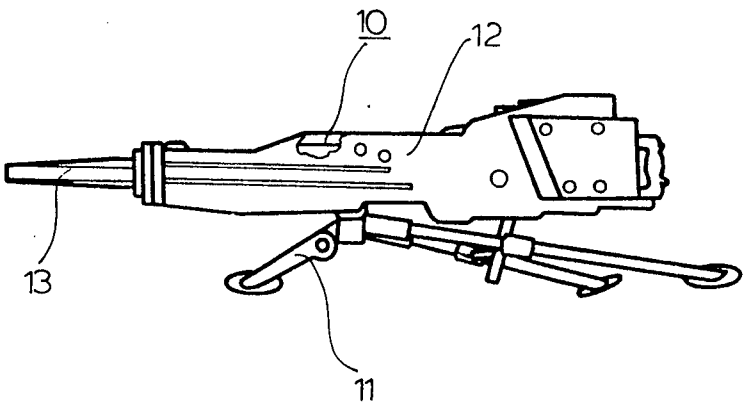
FIG. 1 is a perspective view of a heavy weapon in accordance with this invention mounted on a tripod.
Figure 2B:
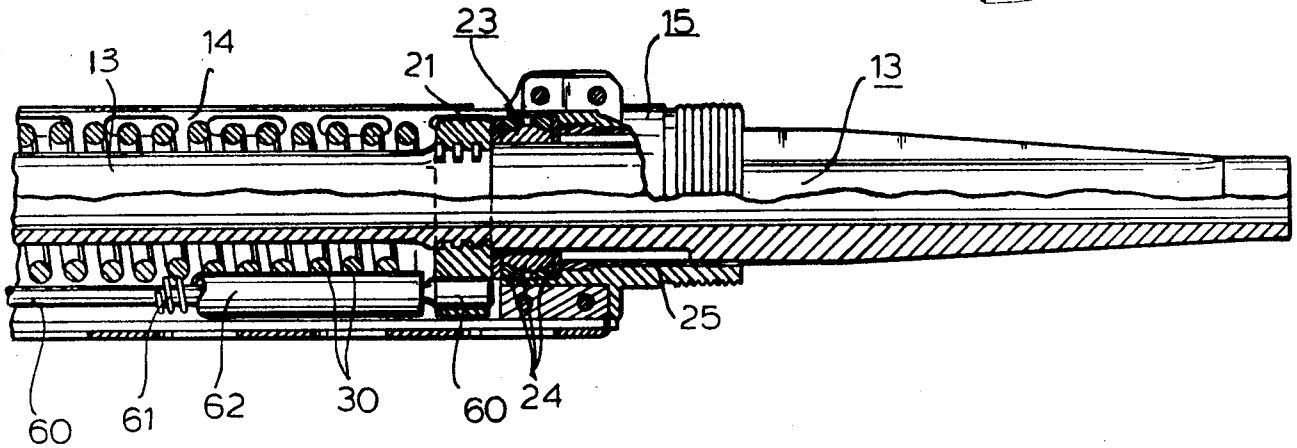
FIG. 2B is a continuation of the sectional elevation view of the weapon of FIG. 2 showing the forward end of the weapon.
Figure 3A:
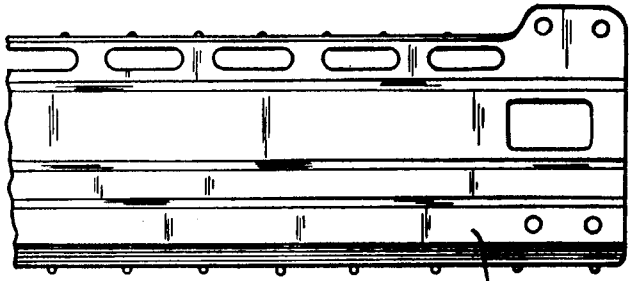
FIG. 3A is a continuation of the sectional elevation view of the receiver of FIG. 3 showing the forward end of the receiver.
Figure 1A:
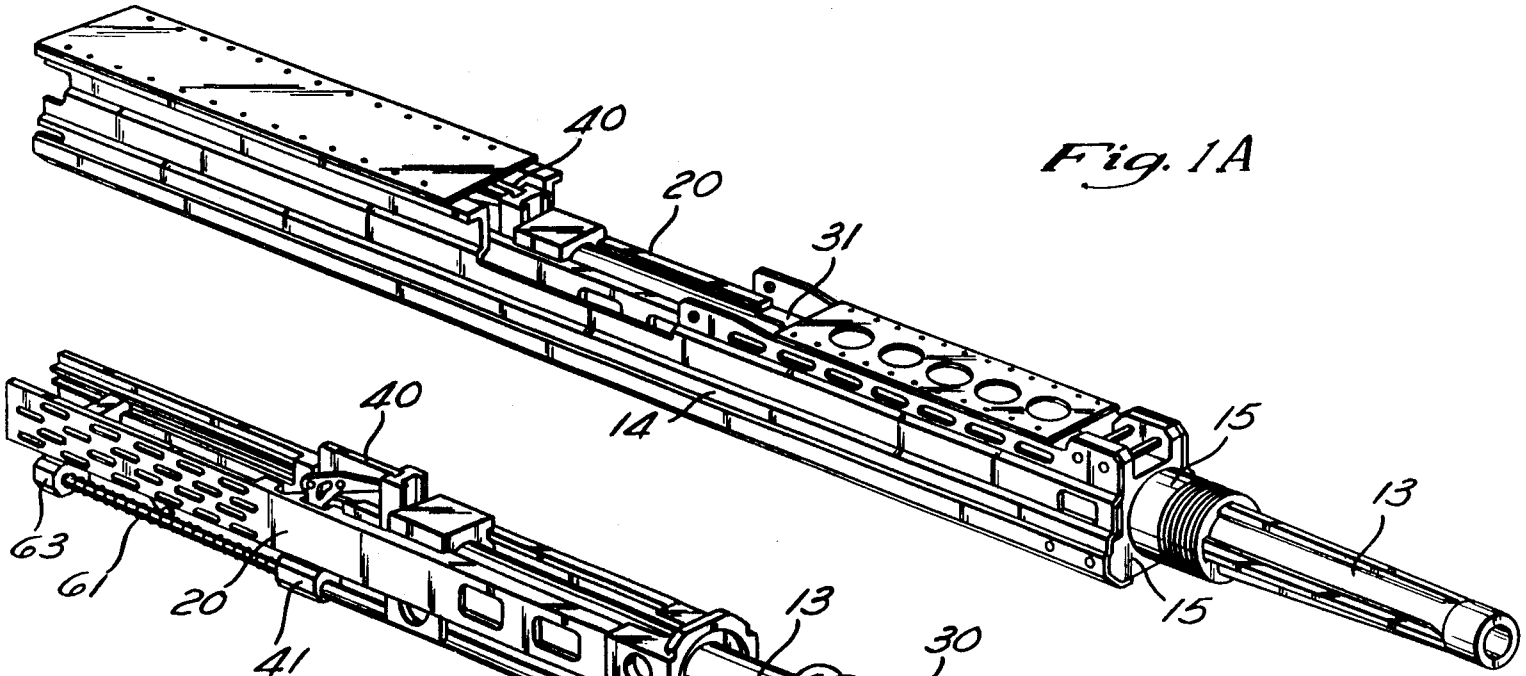
FIG. 1A is a right forward perspective view of the weapon of FIG. 1 enclosed within the receiver.
Figure 1B:
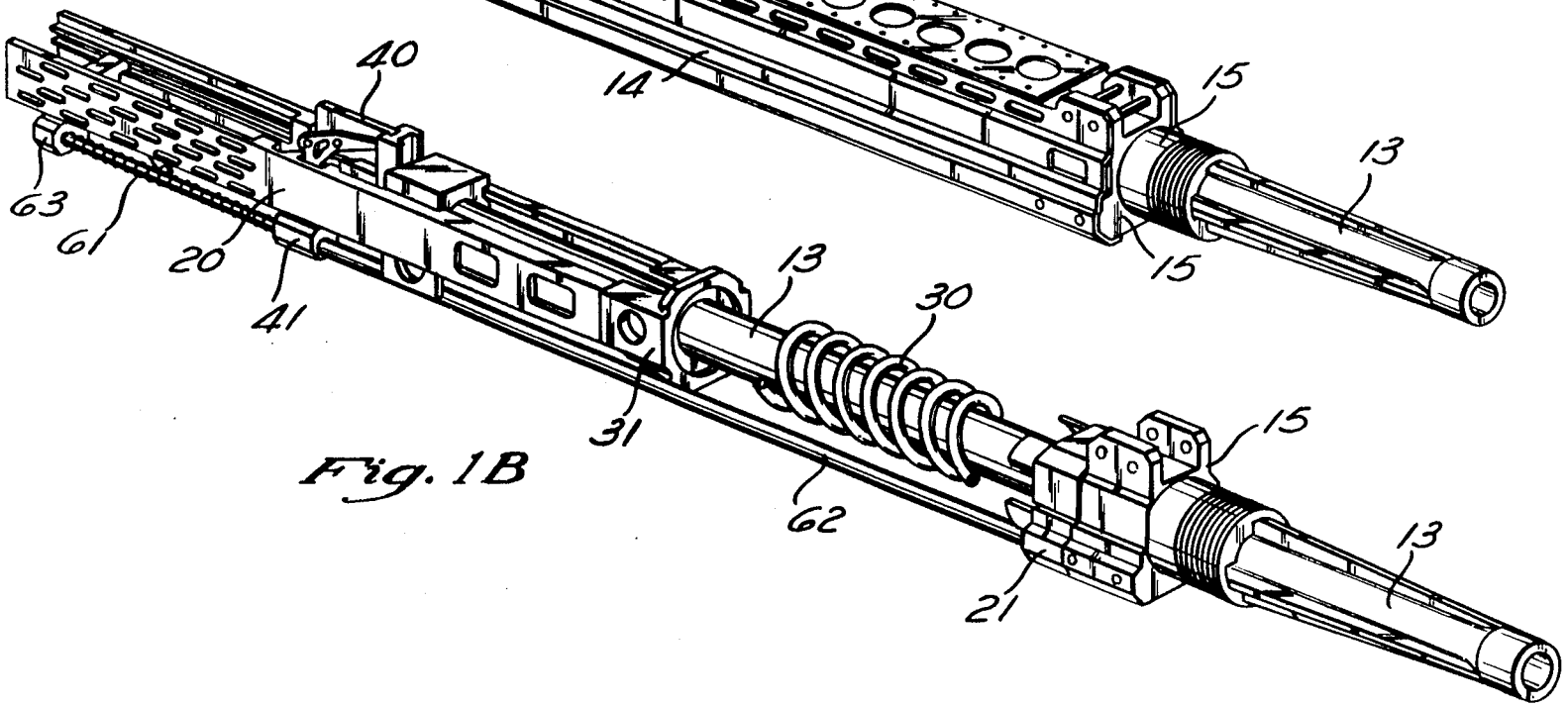
FIG. 1B is a right forward perspective of the weapon without the receiver shown.
Figures 2, 2A, 3:
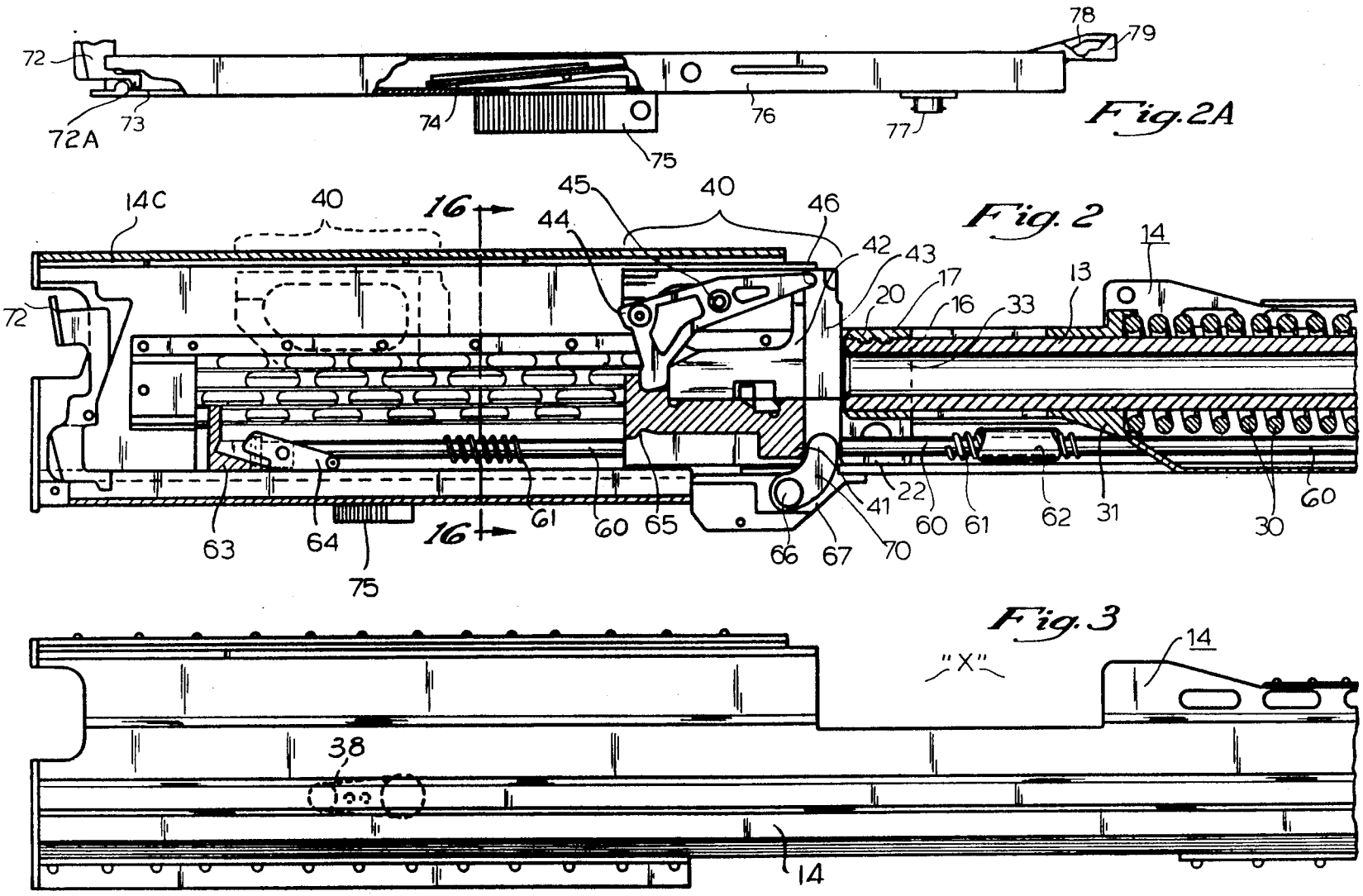
FIG. 2 is a side elevational view, partly in section, of the weapon of FIG. 1 without its housing.
FIG. 2A is a side elevational view, partly in section, of the trigger bar assembly.
FIG. 3 is a side elevational view of the receiver thereof.
Figure 9:
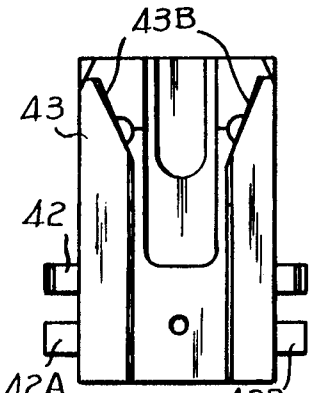
FIG. 9 is a front elevational view of the bolt and bolt face of FIG. 4.
Figure 8:
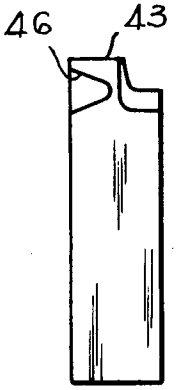
FIG. 8 is a side elevational view of the bolt face of FIG. 4.
Figure 7:
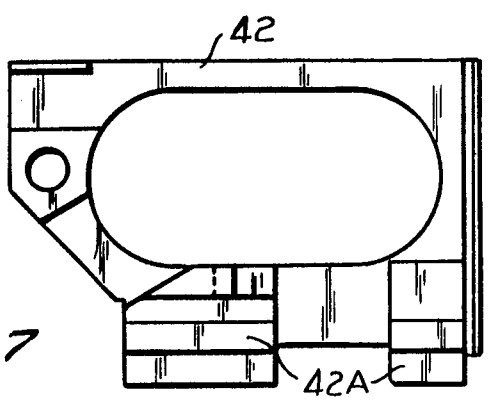
FIG. 7 is side elevational view of the bolt of FIG. 4.
Figure 10:
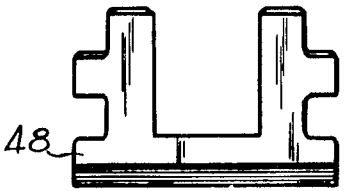
FIG. 10 is a front elevational view of the lock of FIG. 4.
Figure 6:
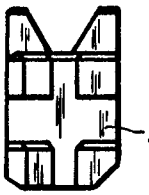
FIG. 6 is a side elevational view of the lock of FIG. 4.
Figure 5:
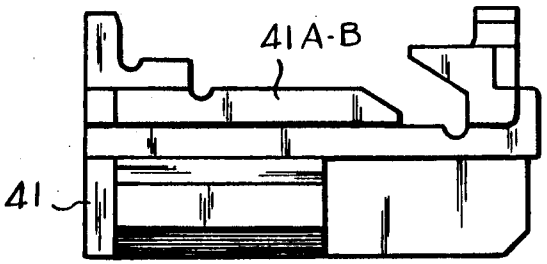
FIG. 5 is a side elevational view of the slide of FIG. 4.
Figure 11:
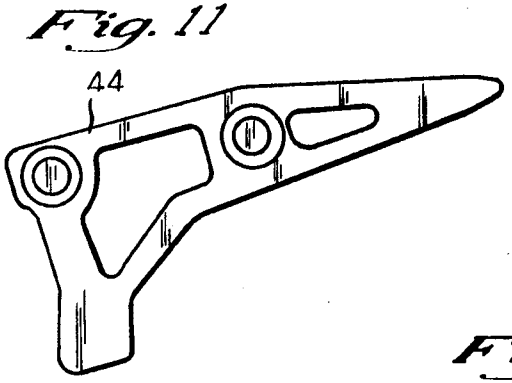
FIG. 11 is a side elevational view of the bolt face lever of FIG. 4.
Figure 6A:
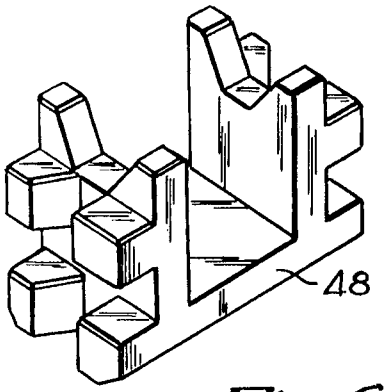
FIG. 6A is a perspective view of the lock of FIGS. 6 and 10.

Referring now to FIGS. 1, 2 and 3, a 30 millimeter, air-cooled, recoil operated heavy machine gun is disclosed. It is shown in FIG. 1 and in FIG. 2, without mount, housing and feed assemblies for clarity since the inventions present in this embodiment do not involve either of these subassemblies. Suffice it to say, the weapon, generally designated 10, may be trunnion mounted on a tripod 11 or pedestal or other suitable mount of various types used for heavy machine guns. This weapon 10, in its cradle 12, may be substituted for the standard air-cooled 50 caliber U.S. machine gun on the same mount.

The weapon may be fed with cartridges by any suitable feed mechanism which furnishes live rounds sequentially to the bolt face as described below. Clip or magazine or belt feed systems may be used with this weapon as well as linkless feed systems provided they furnish cartridges to a position marked X in FIG. 3 above the weapon. Magazine feed is preferred because of its low cost and simplicity as well as reliability.

Now referring specifically to FIGS. 1A–1C and 2, the weapon 10 includes a barrel 13 secured by $\frac{1}{8}$ turn interrupted threads or bayonet joint to a barrel yoke 21 in receiver 14 aft of a front housing assembly 15. The barrel 13 is secured at the chamber end 16 by similar $\frac{1}{8}$ turn interrupted threads in a barrel extension 20. The barrel 13 is surrounded at approximately its forward $\frac{1}{3}$ position by the barrel yoke 21. The front housing 15 includes a secondary spring assembly 23 in the form of an edgewater spring made up of three concentric rings 24 with overlapping tapered surfaces. The edgewater spring has extremely short deflection range, i.e., 0.10 in at 22,000 lbs. loading. This spring 23 acts as a buffer to absorb the counter-recoil load and to prevent the barrel from over travel during the recoil phase in case of overcharged rounds being fired.

Figure 1C:
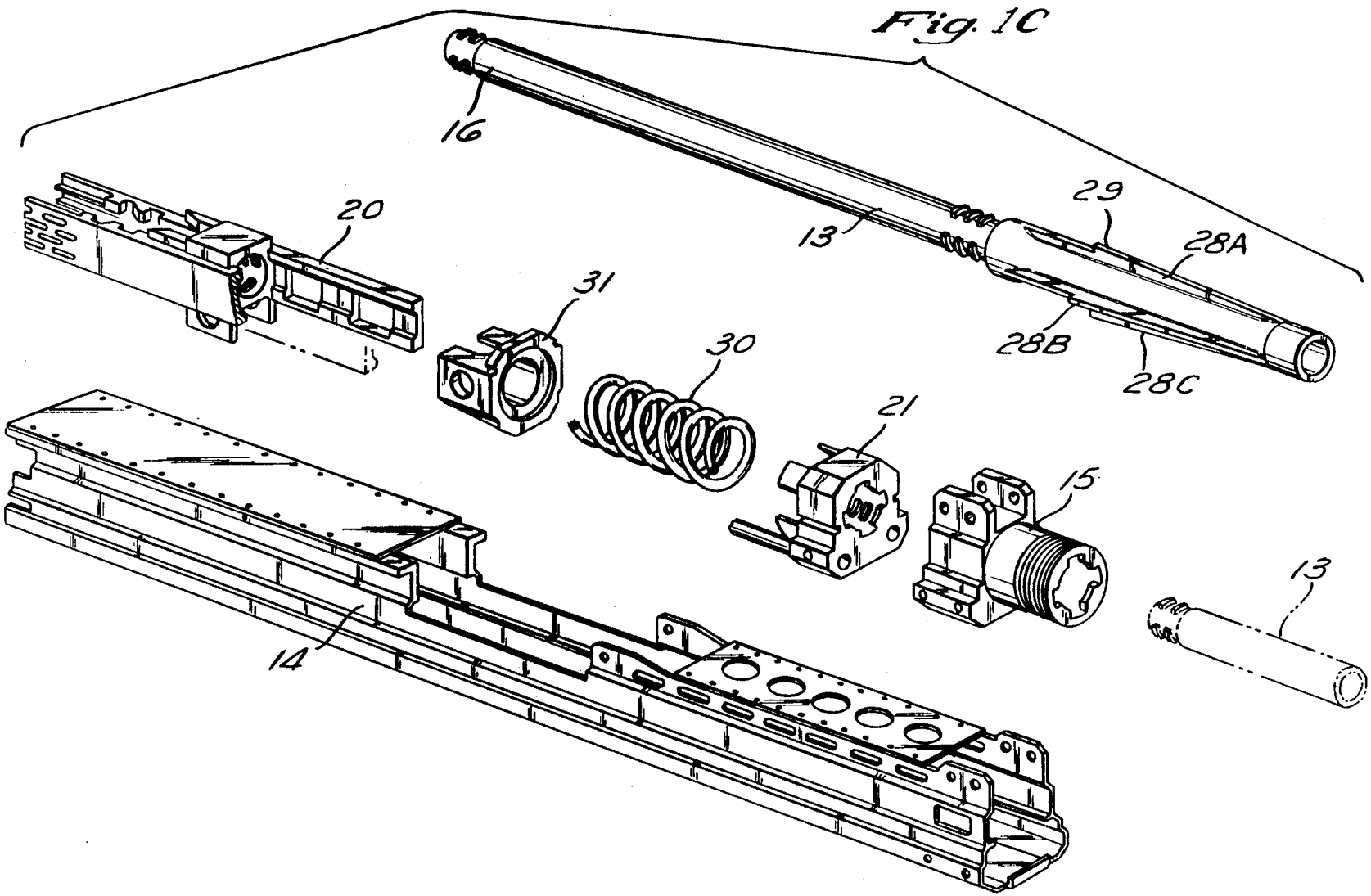
FIG. 1C is a right forward perspective of several components of the weapon of FIGS. 1A and 1B.

In the barrel 13, best seen in FIGS. 1C and 12, the forward $\frac{1}{3}$ is finned at 90 degree intervals and a barrel bushing 25 is slotted to receive the barrel fins 28A–D, three of which appear in FIG. 12. The barrel bushing is included within the front housing assembly.

The barrel yoke 21 provides a surface for the main recoil or barrel spring 30 to bear against and to transmit recoil pressure from the barrel 13 to the spring 30. The opposite or aft end of the recoil spring 30 bears against the spring stop 31 which establishes with the yoke 21 a static compressive pre-load of approximately 1,200 pounds on the recoil spring 30. The spring stop 31 engages the receiver, generally designated 14.

As shown in FIG. 2, the barrel 13 defines a chamber 33 at its rearmost end with a bolt and slide assembly 40 located immediately behind the barrel chamber 33 when the weapon is at battery.

Figure 4D:
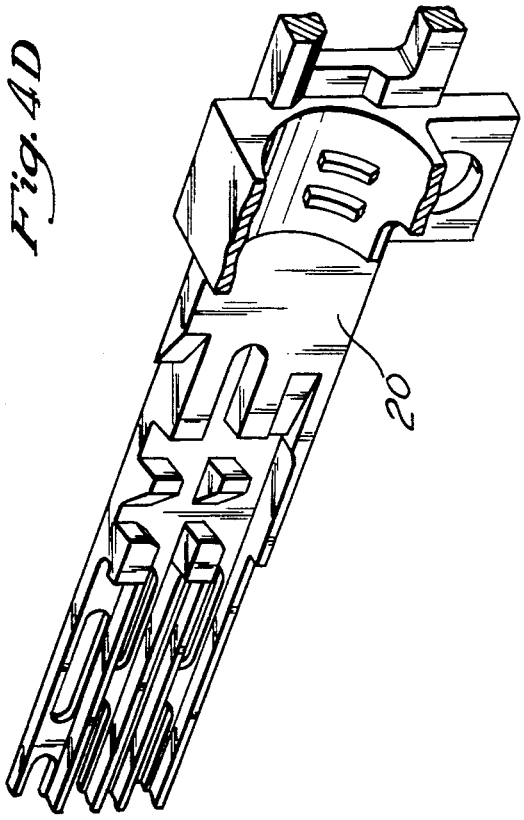
FIG. 4D is a right forward sectional perspective of the barrel extension of FIG. 4C.
Figure 4B:
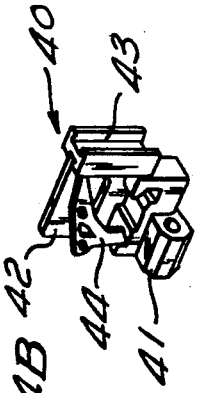
FIG. 4B is a right forward perspective of the slide/-bolt assembly.
Figure 4C:
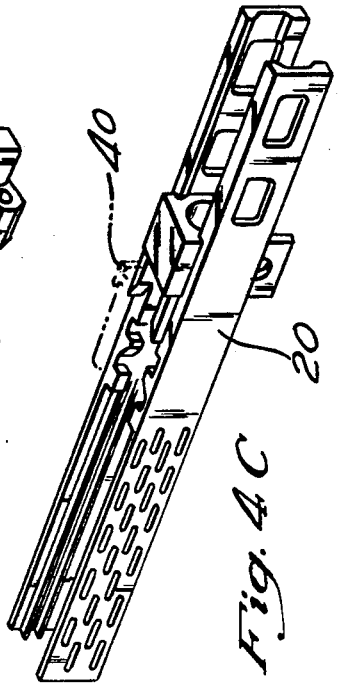
FIG. 4C is a right forward perspective of the barrel extension indicating the location of the slide/bolt assembly in battery position.

The bolt and slide assembly 40, better seen in FIG. 4, comprises a slide 41 which carries a bolt 42 having a movable front bolt face 43. The bolt face 43 is movable from the battery position shown in FIG. 2 downward to a chambering position during cycling of the slide and bolt assembly 40. The bolt face 43 is driven cyclically upward and downward relative to the bolt by the bolt face levers 44 which engage notches 46 in the rear face of the bolt face 43. The bolt face lever 44 is operated by cam followers 45 which travel in tracks in the receiver 14 illustrated in FIG. 16.

The bolt and slide assembly 40 is driven cyclically rearward and returned by driving springs 61 encircling buffer rods 60 which are enclosed within slide extension tubes 62. During the cycling of the bolt assembly, the bolt face 43 additionally travels vertically under control of the bolt face levers 44. Operation of the bolt slide assembly is best understood by reference to FIG. 17A–I and the description below.

FIRING CONTACTOR ARRANGEMENT

In FIG. 4, the breakway section of the slide 41 and bolt 42 show a boss 130 which contains a firing contactor assembly 131, best seen in FIG. 4A.

Referring now to FIG. 4A, the boss 130 constitutes an upward extension of the slide 41 and contains an electrically insulated contactor assembly 131 which comprises a threaded sleeve insulator 132 and a conducting metal sleeve retainer 133 with a front opening through which a probe 134 extends forward. The probe 134 is biased forward by spring 135 which is retained in cylindrical chamber 136 of retainer 133 by screw plug 140.

Extending upward through a port 141 in the slide body 41 is a contact spring 142 which terminates at its bottom in contact with a slide electrical contactor 143 extending out of the bottom of the slide 41 and spring loaded downward. The contactor 143 engages the electrical contact 78 of FIG. 2A whenever the slide assembly is forward in the closed bolt position. Electrical conductivity exists continually between the contact 143 and the probe 134.

The bolt face includes a firing probe 150 spring loaded rearward in a recess by spring 152. The spring 152 and probe 150 are located in a cylindrical recess 153 (within the threaded sleeve insulator 151 and a metal sleeve retainer 154) in the bolt face 43.

When the slide and bolt are locked and the bolt face 43 is up, directly aligned with the front of the probe 134 is the firing probe 150. Whenever the slide bolt assembly is fully locked forward, the probe 134 makes electrical contact with the rear of the firing probe 150 driving it forward against the spring 152 and into contact with the electrically fired primer of such 30 mm ammunition as NATO common ADEN or DEFA and US cartridges. An electrical conducting path then exists from the connector 77 and ramp contact 78 of FIG. 2A to the chambered round.

Whenever the slide bolt group is in motion or rearward, the firing probe 150 is retracted by spring 152 and thereby out of any interference with vertical movement of the bolt face 43.

BARREL ASSEMBLY

Referring now to FIGS. 1C and 2 in connection with FIGS. 12 et seg., the barrel 13 is secured at its aft end 16 by ⅛ turn or bayonet lock to the barrel extension. Slightly forward of the center of the length of the barrel 13 is the barrel yoke 21 that can be secured to the barrel 13 by similar ⅛ turn lugs. Within the front housing 15 and forward of the barrel yoke 21 is an edgewater spring assembly 23 comprising three reverse tapered rings 24. Forward of the edgewater spring assembly 23 is a barrel bushing 25 best seen in FIGS. 13 and 14. The barrel bushing 25 includes four pair of sliding bearing surfaces 26A–D and four clearance spaces 27A–D extending radially outward from these surfaces. The bearing surfaces 26A–D each bear on respective slide walls of ribs 28A–D of the barrel 13, three of the ribs 28 showing in FIG. 12. The ribs 28A–D each include a uniform width and height section 29 of approximately three inches (7.6 cm.) in length which rides in the barrel bushing 25. Forward of the uniform width section 29, the ribs 28 are tapered to zero height near the muzzle. The bearing surfaces 26A–D accurately position the barrel surfaces 29 at approximately ⅔ of its distance from the chamber end 16 to muzzle, thereby increasing the accuracy of the weapon. The bearing surfaces 26A–D define two pair of orthoginal intersecting planes embracing the bore centerline of the gun.

As the barrel heats from firing, its radial expansion results in radial expansion of the rib section 29 into the clearance spaces 27 without significant loss of accuracy since the bearing surfaces are generally normal to the major expansion. Transverse expansion of the ribs is generally matched by transverse (radial) expansion of the barrel bushing 25. The presence of the barrel bushing 25 and its precise barrel positioning provides first round accuracy. The same feature including a radial expansion provision maintains that accuracy during sustained firing. The ribs further stiffen the barrel and aid in thermal radiation.

BUFFER GROUP AND OPERATION

Figure 15:
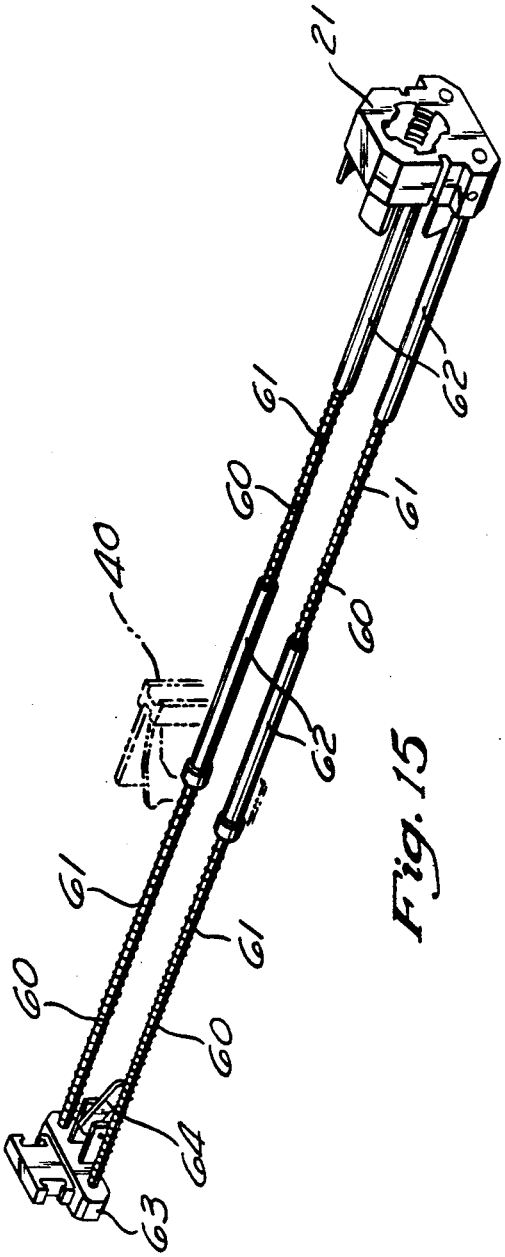
FIG. 15 is an exploded view of the buffer assembly of this invention.

The buffer group is best seen in FIGS. 15, 15A, 15B and 16. It includes the buffer rods 60 and their encircling driving springs 61. The buffer rods 60 both terminate at a buffer plate 63 and are secured thereto by threads directly engaging the buffer plate 63. The buffer plate 63 carries a pivotally mounted sear 64, designed to engage the stop 65 of the slide 41, best seen in FIG. 4. The slide 41 is also shown in FIG. 15 on the buffer rods 60.

The buffer group including the buffer plate 63 and buffer rods 60 provide a transfer of the energy of the accelerated slide-bolt assembly 40 forward to the barrel 13 and recoil spring 30 to reduce the impact or spike loading of the weapon on its mount. A graphical comparison of the force-time diagrams of this invention as compared with the conventional recoil buffer system of the same caliber weapon is illustrated in FIGS. 19 and 20.

Referring now to FIGS. 19 and 20, the areas under the curves represent the energy to be dissipated and in each case are equal. The times are equal for equal firing rates but the peak energy spike is lower in this weapon. This allows our weapon to be fired from lighter mounts than would be expected and produces the weight and strength requirements of various elements of the weapon. In this case, the receiver 14 is entirely fabricated of extruded aluminum with full assurance of adequacy of strength.

CHARGING ASSEMBLY

Figure 16:
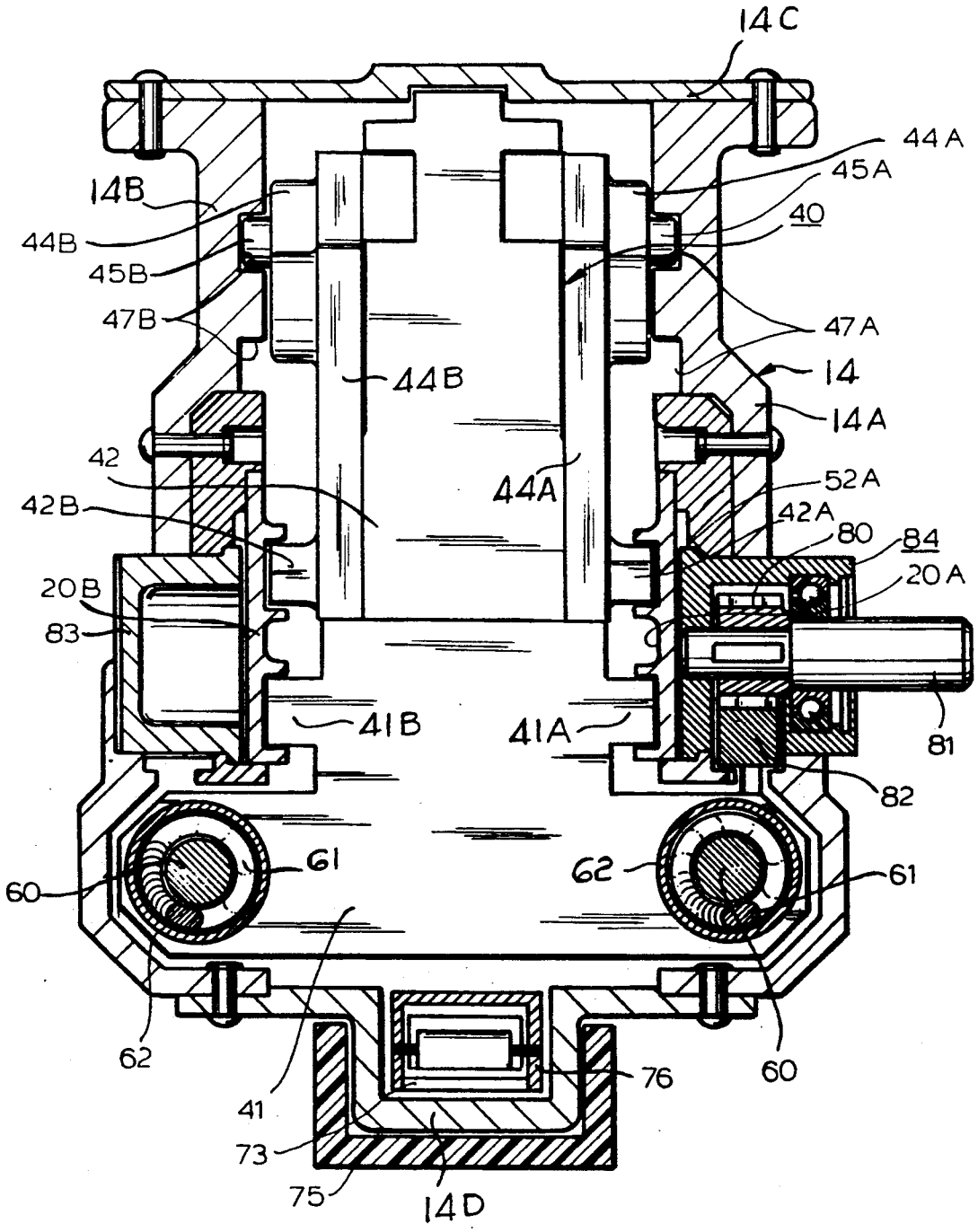
FIG. 16 is a vertical sectional view of the weapon of FIG. 2 taken along line 16—16 of FIG. 2.

In adddition to the showing of FIGS. 2 and 3, the charging assembly for the weapon appears in FIG. 16. The receiver 14, does not absorb recoil energy and therefore, as indicated, may be fabricated of lighter weight materials. Near mirror image parts 14A and B define the receiver with top and bottom plates 14C and D, respectively. These may be riveted together as illustrated.

The side 14A of receiver 14 mounts the charging pinion assembly 84 and rack 82. As shown, these are adapted for right hand charging of the weapon with a crank, shown in phanthom form in FIG. 3 as crank 38, or by other means. Left hand charging is possible by removal of a plug 83 and by installation of the pinion assembly 84 and rack 82 on the left side of the weapon.

The receiver 14 encloses the slide and bolt assembly 40. The slide 41 may be seen in FIG. 16. The bolt 42 rides above the slide 41 on side wings 42A and B extending into the track of the barrel extension 20A and B.

The slide 41 includes wings 41A and B which ride in tracks of barrel extension 20A and B.

FIG. 16 also illustrates the lateral position of the bolt face levers 44A and B and their actuating cam follower pins 45A and B which ride in cam grooves 47A and B of receiver walls 14A and B respectively.

Referring now to FIGS. 2 and 2A, the trigger 72 includes a finger 72A which extends downward below the trigger pivot and engages a trigger bar 73, pulling the trigger bar 73 aft, operating the trigger switches 122 and 122A of FIG. 22. Pivotally mounted in the trigger bar housing 76 is a sear release lever 74 which is actuated upward whenever a selector lever 75 is moved rearward in the closed bolt position. The sear release lever 74 engages the underside of the sear 64 of FIG. 2 causing it to pivot downward out of engagement with the slide sear catch 65 of FIG. 3.

Figure 22:
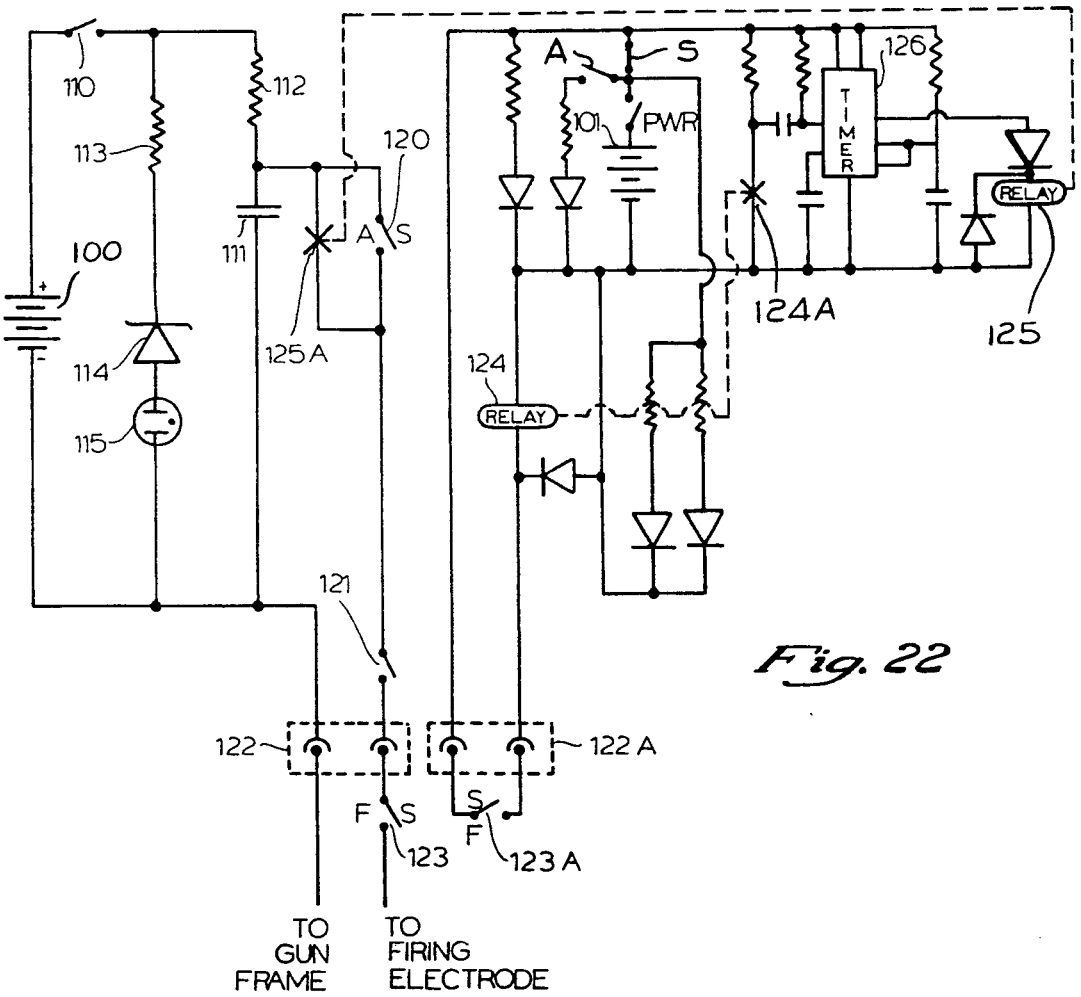
FIG. 22 is an electrical schematic diagram thereof.
Figure 21:
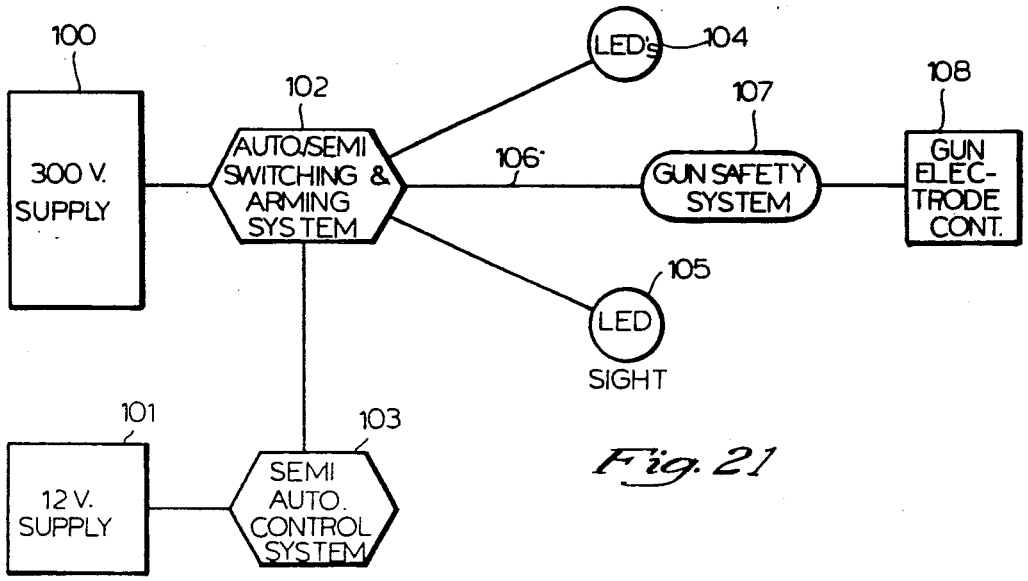
FIG. 21 is a block diagram of the electric firing circuit of the weapon.

The trigger bar 73 is enclosed in a trigger bar housing 76 which mounts an electrical connector 77 which provides all electrical inputs to the gun proper from the circuitry of FIGS. 21 and 22.

The trigger bar housing 76 also includes a ramp electrical contact 78 in insulator 79. The electrical contact 78 applies firing voltage to the electrical contactor assembly 143 of FIG. 4A.

FIRING CIRCUIT

The weapon, as disclosed, is electrically fired although percussion firing is compatible with the weapon. The electrical firing circuit is disclosed in FIG. 21 in block diagram form and FIG. 22 in schematic form.

In FIGS. 21 and 22, two power supplies 100 and 101 are shown. The supply 100 has a nominal 300 volt dc output and is used to electrically fire the rounds via the switching arming system 102. Supply 101 is a 12 volt dc source used for powering the control system 103. Indicator lamps 104 and 105 show the current status of the gun. The switching and arming system applies the 300 volt firing voltage over lead 106 via the gun safety system 107 to the gun electrode contactor 108 in the bolt face 43 of FIG. 4.

In FIG. 22, the 300 volt supply 100 is shown connected via main normally open power switch 110 to a capacitor 111 via current limiting resistance 112 to charge the capacitor to 300 volts. A parallel circuit including resistance 113, zenor diode 114 amd low battery indicator diode 115 show battery condition.

When an AUTO/SEMI switch 120 is closed (AUTO position), an arm switch safety 121 and trigger switch 122 are closed, capacitor 111 is discharged through the electrode contactor and the cartridge primer and the round is fired. As soon as the electrical connection through the spent cartridge is opened upon firing, the capacitor 111 starts to recharge and is fully charged to 300 volt in approximately 40 milliseconds and is ready to fire the next round as long as the trigger switch 122 is operated. Total firing and recharge time is approximately 45 milliseconds. A trigger safety switch 123 is in series with the firing circuit.

An additional circuit is involved in semi-automatic firing. It employs a second pair of trigger switches 122A and second trigger safety switch 123A. If switch 120 of the circuit 102 is in its SEMI position, the firing of the weapon is transferred to the semi-automatic control system 103. Firing occurs when normally open contacts 125A of relay 125 are operated. When the trigger switch 122A is closed, a relay 124 operates which starts a timer 126 which operates relay 125 and holds it for a predetermined period, e.g. 80 milliseconds. As soon as relay 125 releases, capacitor 111 begins its recharge. Relay 125 may not be operated again until the trigger is released and reoperated, reactivating relay 124 and restarting timer 126. Thus, in the semi-automatic fire, one round is fired for each trigger depression.

Figures 17A, 17B, 17C, 17D, 17E:
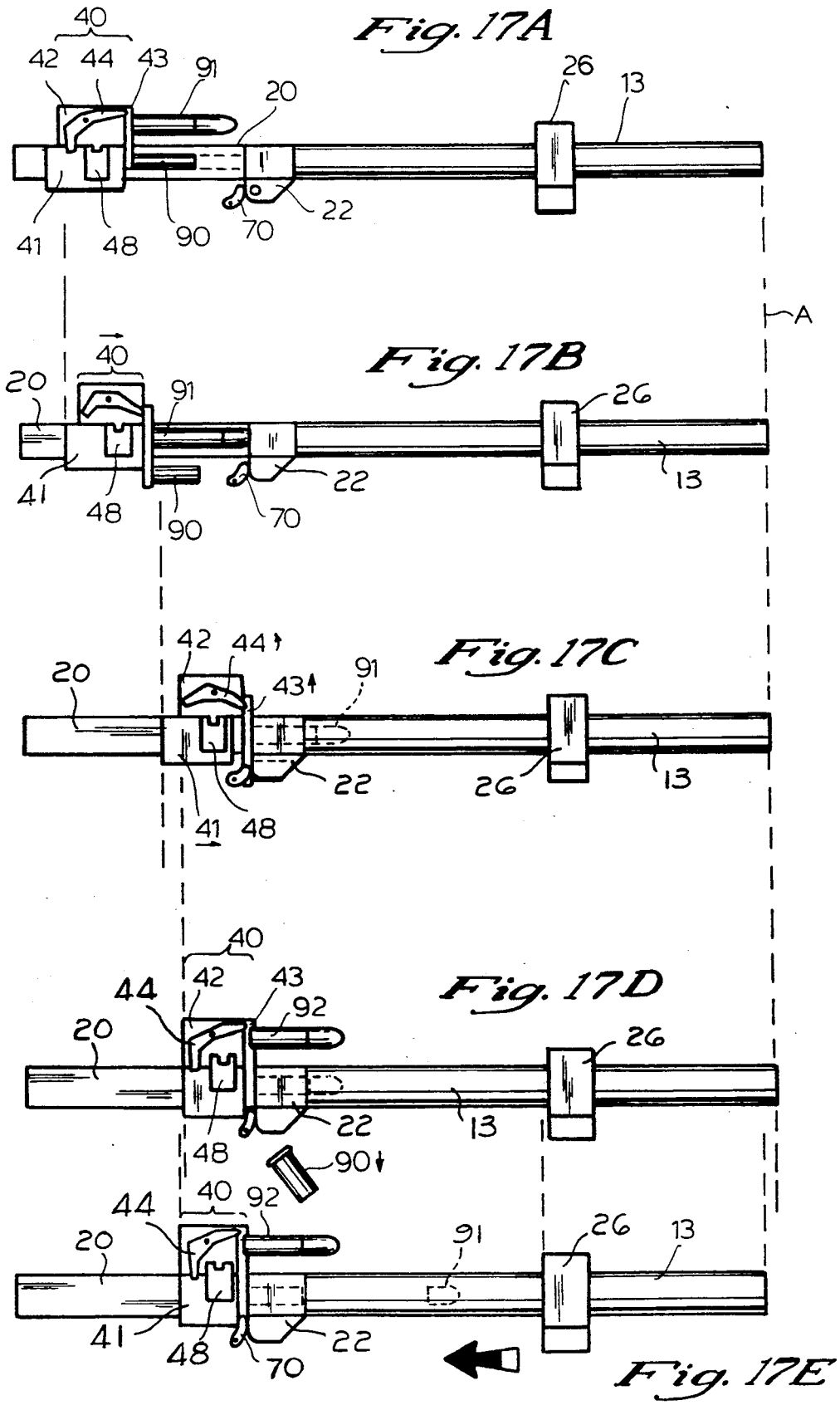

In FIG. 17B the sear 64 of FIG. 2 has been released and the slide and bolt group 40 has been driven forward by the energy stored in the driving springs 61 of FIG. 2. On forward movement the bolt face lever 44 is cammed downward as is illustrated in FIG. 17 on movement from position 17A to position 17B. The lever drives the bolt face downward, placing the ready round 91 in position, and as shown, partly entering the chamber 33. The spent case 90 is removed to ejection position below the barrel. The lock 48 remains down during this operation.

In FIG. 17C the bolt 42 is at battery, the ready round 91 has been chambered, the slide 41 continues in forward motion, and the lock 48 is down. In further FIG. 17D, further forward movement of the slide 41 causes the bolt face lever 44 to be cammed upward raising the bolt face 43 and ejecting the spent case 90 downward with little forward velocity. If the next round 92 is in position, it is picked up by the bolt face 43 on rising. The lock 48 is additionally cammed upward locking the bolt slide group 40 and the chamber 33 is fully closed, the system is locked and loaded and ready to fire.

The weapon at the moment of firing is illustrated in FIG. 17E with the bolt slide group 40 fully locked as long as firing pressure remains in the barrel. The barrel 13 and bolt slide group 40 as well as the ready round 91 begin recoil movement.

In FIG. 17F, the accelerator 70 is pivoted on the accelerator shaft and is cammed rapidly rearward accelerating the slide 41 with respect to the bolt 42 and barrel 13. This relative movement of the slide and the bolt cams down the lock 48 and unlocks the slide-bolt group 40 from the barrel 13.

As illustrated in FIG. 17G, after unlocking of the slide and bolt group 40 from the barrel 13, the accelerator 70 continues to be pivoted aft about the accelerator shaft 66 secured to the receiver 14 within the accelerator housing 67. Accelerator 70 movement results from the last rearward movement of the barrel 13 imparting an independent acceleration of the slide and bolt group 40, ready round 91, and spent case 90 rearward by accelerating the slide using the barrel recoil energy. A substantial amount of the recoil energy is transferred from the barrel 13 to the slide and bolt group 40.

The barrel 13 returns to battery driven by the barrel spring 30.

As illustrated in FIG. 17H, the slide and bolt group 40 with the ready round 91 and spent casing 90 continue rearward until they strike the buffer plate 63, and the energy of the slide and bolt group 40 is transferred to the buffer assembly and thus to the barrel 13 via the buffer rods 60. The barrel 13 in actuality-recoils rearward of the battery position compressing the sbarrel recoil spring 30 in the order of 1.5 inch minimizing any spike loading on the gun mount.

If the sear 64 is up, the slide and bolt group 40 remain aft, as shown in FIG. 17A. If the sear 64 is released, then as illustrated in FIG. 17B, the slide and bolt group 40 rebound off of the buffer group, and driven by the driving springs 61, are returned to position C.

By the transfer of recoil energy and acceleration rearward of the slide and bolt group 40 separate from the barrel 13, the recoil energy in the barrel is reduced. The impact load upon the slide and bolt group 40 striking the buffer assembly is transferred back to the barrel through the buffer rods 60. That energy is dissipated by a secondary recoil absorbed by the barrel spring. The receiver carries no major part of the recoil counter-recoil loading, eccept the static preload of the barrel spring of approximately 1000–1500 pounds.

SLIDE-BOLT ASSEMBLY CYCLING

The cycling of the slide-bolt assembly 40 in addition to FIG. 17 is graphically illustrated by FIG. 18 in which a track 47U and L of the receiver wall 14B is shown extending between the plate 53 at the forward end, and switch plate 54 at the aft end. The receiver wall 14B includes the major length of the straight upper and lower cam tracks 47U and 47L. Cam followers 45 of FIG. 16 engage the tracks 47U and 47L and cycle from positions A to I and repeat during the firing of each round. The tracks 47U and 47L are parallel to each other and to the bore of the barrel 13. Lower track 47L is positioned to place the bolt face 43 with the live round aligned with the chamber 33 of the barrel 13 of FIG. 2. Upper track 47U is positioned to allow the bolt face 43, on rearward movement, to carry a ready round rearward clear of the barrel 13.

The switch plate 54 includes a ramp 56 which depresses spring loaded bolt face lever pins 45A or B allowing the pin to drop off the ramp edge 57 during rear movement. Thereafter on forward movement, the pin 45A or B is driven down the switch path 58 to the lower track 47L. The pins therefore cycle in a couterclockwise direction to the various positions indicated by letters corresponding to the views of FIG. 17.

CHARGING CYCLE

Referring now to FIG. 2 in conjunction with FIG. 21, the weapon 10 is charged by the sequential steps of:

1) set selector 75 to open bolt mode;
2) providing a round in the bolt face 43 at the ready position "X" of FIG. 3 by clip, magazine belt feed or other means;
3) cranking the pinion 80 by rotation of shaft 81 of FIG. 16 a number of turns, e.g. 5. Pinion 80, by engaging rack 82, drives the bolt slide group 40 rearward to engage sear 64. Return the charging rack by unwinding pinion 80.
4) Chambering a round is accomplished by unsearing the slide bolt assembly 40 by pulling the selector rearward. The assembly 40 moves forward under the force of the driving springs 61. When the bolt face 43 is up, as the assembly 40 moves forward, the switch plates 54 and the tracks force the bolt face 43 downward further and forward motion chambers the round and the bolt is at battery. The slide 41 moves further forward engaging the bolt face lever pivoting it upward, and further ramps the lock upward. The bolt face 43 has captured the ready round 92, the slide 41, bolt 42 and bolt face 43 are locked together and to the barrel 13 by means of the lock engaging mating lugs on the barrel extension 20. Now with the selector aft, closed bolt (semi-automatic) firing is selected. Upon returning to battery, the bolt face 43 is cammed upward picking up the ready round 91.

FIRING CYCLE

5) Firing is accomplished by depressing the triggers with the gunner's thumbs. A single round is then fired.
6) In automatic firing, the selector switch is moved forward to open bolt mode. The sear is thereby engaged and firing continues as long as rounds are supplied to the bolt face 43 and the trigger is depressed. When the trigger is released, the slide-bolt assembly 40 is held on sear with the next round ready for chambering. The bolt is open. Alternatively, the bolt can be closed by movement of the selector 75 of FIG. 2A for closed bolt operation, and the power supply semi/automatic selector set for automatic fire. Thus set, the gun will fire in an automatic mode from the closed bolt.
7) Further trigger operation resumes automatic fire.

The above described embodiments of this invention are merely descriptive of its principles and are not to be considered limiting. The scope of this invention instead shall be determined from the scope of the following claims, including their equivalents.

What is claimed is:

1. A heavy support weapon having reduced peak recoil loading comprising:

a barrel;
a barrel yoke for engaging said barrel;
a barrel recoil spring;
means positioning said recoil spring extending between said barrel yoke and an aft region of said barrel;
a barrel recoil spring support located aft of said recoil spring and secured to a support for said heavy support weapon;
a slide-bolt assembly;
means mounting said slide-bolt assembly for rearward movement from a position adjacent to a chamber end of said barrel;
a buffer assembly mounted in the path of rearward movement of said slide-bolt assembly such that after said slide-bolt assembly moves longitudinally in a rearward direction for a finite distance, said slide-bolt assembly strikes said buffer assembly; and
means, in addition to said positioning means and said mounting means, for securing said buffer assembly to said barrel, whereby rearward induced movement of said slide-bolt assembly upon firing of the weapon is imparted to said buffer assembly and transferred to said barrel and barrel recoil spring rather than to said positioning means and said mounting means, and reduced loading is transferred to the support for said heavy support weapon.

2. A heavy support weapon in accordance with claim 1 including accelerator means engaging said barrel and said slide-bolt assembly comprising:

means responsive to rearward movement of said barrel to impart additional acceleration into said slide-bolt assembly with respect to said barrel, whereby part of the recoil energy of said barrel is imparted to said slide-bolt assembly.

3. The combination in accordance with claim 2 wherein said accelerator means includes a pawl pivotally secured to a receiver that encloses and supports the aft portion of said barrel for rotation by rearward movement of said barrel and further includes a pawl deflecting means secured to said barrel, whereby said pawl deflecting means deflects said pawl to drive said slide-bolt assembly rearward at a faster rate than the rate of recoil movement of said barrel.

4. A heavy support weapon comprising:

a barrel including a chamber and a bore;
a barrel extension coupled to the rear of said barrel;
a slide mounted within said barrel extension for reciprocal movement along a path rearward of the chamber of said barrel;
a bolt carried by said slide;
a main barrel spring encircling a portion of the length of said barrel;
a receiver attached to said barrel and enclosing said barrel extension;
forward stop means for said main barrel spring secured to said barrel;
a rearward stop for said main barrel spring supported by said receiver;

a buffer assembly including stop means mounted in the path of and terminating the rearward movement of said slide upon recoil of said barrel during firing; and means, in addition to said barrel extension and said receiver, coupling said buffer assembly to said barrel whereby energy imparted to said buffer assembly, upon rearward movement of said slide, is transferred to said barrel spring rather than to the receiver of barrel extension of said heavy support weapon.

5. The combination in accordance with claim 4 wherein said coupling means comprises a pair of rods attached to said buffer assembly and extending to said barrel.

6. The combination in accordance with claim 4 wherein said barrel extension includes both camming means and accelerator means adjacent to said slide and responsive to rearward movement of said barrel and slide upon recoil of the barrel after firing, said accelerator means being cammed to accelerate said slide rearward separate from said barrel.

7. The combination in accordance with claim 4 including secondary barrel spring means comprising an edgewater spring assembly coupling said barrel to said forward stop means for said main barrel spring.

8. The combination in accordance with claim 4 wherein said bolt includes a separate bolt face and said receiver includes cam tracks and further includes lever means engaging said cam tracks and said bolt face for reciprocating said bolt face transverse to the direction of movement of said slide.

9. The combination in accordance with claim 8 wherein said bolt face is secured to said bolt for reciprocal upward and downward movement from a position extending above the barrel chamber to a position below the barrel chamber.

10. The combination in accordance with claim 9 including lock means for securing said bolt and bolt face to said slide when said bolt face is in chamber closing position.

11. The combination in accordance with claim 8 wherein said receiver includes track means defining a path for cyclical movement of said bolt face from a cartridge receiving position to a cartridge chambering position responsive to barrel recoil movement.

12. The combination in accordance with claim 8 wherein said bolt face engaging means comprises a lever carried by said bolt, reciprocated by engagement with the cam tracks and actuating said bolt face by contact with the rear side thereof.

13. A weapon comprising:

a barrel including a bore and a chamber;

means for mounting said barrel;

a recoil spring coupled to said barrel to absorb recoil energy, and a bolt mounted in bolt mounting means for closing the chamber end of the barrel;

said bolt mounted for rearward movement with respect to the barrel to open the chamber, to insert an unfired round, and to remove a spent cartridge casing;

said means for mounting the bolt including accelerator means for accelerating rearward movement of the mounted bolt upon recoil movement of said barrel;

buffer stop means for limiting the rearward travel of said mounted bolt, mounted in the path of rearward movement thereof, such that after said mounted bolt moves in a longitudinally rearward direction for a finite distance, said mounted bolt strikes said buffer stop means; and means, in addition to said bolt mounting means and said barrel mounting means, for securing said buffer stop means to said barrel, whereby loading of said buffer means is transferred to said barrel rather than to said bolt mounting means and said barrel mounting means.

14. The combination in accordance with claim 3 wherein said means for mounting said bolt comprises a slide and said means for transmitting load from said buffer means to said barrel comprises a stop and at least one buffer rod extending between said stop and said barrel.

* * * * *